United States Patent [19]

Suzuki et al.

[11] 4,165,393

[45] Aug. 21, 1979

[54] MAGNETIC BRUSH DEVELOPING PROCESS FOR ELECTROSTATIC IMAGES

[75] Inventors: Kohji Suzuki; Manabu Mochizuki, both of Kawasaki; Hajime Oyama, Tokyo; Teruyuki Ohnuma, Yokohama, all of Japan

[73] Assignee: Ricoh Co., Ltd., Tokyo, Japan

[21] Appl. No.: 742,707

[22] Filed: Nov. 17, 1976

[30] Foreign Application Priority Data

Nov. 26, 1975 [JP] Japan ..... 50-141409

[51] Int. Cl.[2] ..... G03G 13/09

[52] U.S. Cl. ..... 427/18; 96/1 SD; 252/62.1 P

[58] Field of Search ..... 427/18; 19/1 SD; 252/62.1 P, 62.1 PM

[56] References Cited

U.S. PATENT DOCUMENTS

| | | | |
|---|---|---|---|
| 2,919,247 | 12/1959 | Allen | 252/62.1 |
| 3,124,457 | 3/1964 | Schwertz | 427/18 |
| 3,219,014 | 11/1965 | Mott et al. | 427/18 |
| 3,262,806 | 7/1966 | Gourge' | 427/18 |
| 3,909,258 | 9/1975 | Kotz | 96/1 SD |
| 4,082,681 | 4/1978 | Takayama et al. | 427/62.1 P |

*Primary Examiner*—Michael F. Esposito
*Assistant Examiner*—Stuart D. Frenkel
*Attorney, Agent, or Firm*—Cooper, Dunham, Clark, Griffin & Moran

[57] ABSTRACT

A magnetic developing process for use in electrophotographic or electrostatic recording techniques employs a magnetic brush formed by a developer which comprises a powder mixture of a low resistance toner and a high resistance toner, at least one of which comprises a magnetic toner. Both toners are triboelectrically charged, and the magnetic toner serves as a carrier, so that both toners are attracted to an electrostatic image to provide a developing thereof.

6 Claims, 4 Drawing Figures

MAGNETIC BRUSH DEVELOPING PROCESS FOR ELECTROSTATIC IMAGES

BACKGROUND OF THE INVENTION

The invention relates to a magnetic brush developing process for use in the electrophotographic and electrostatic recording techniques.

The magnetic brush developing process represents one of the dry type developing processes, and employs a sleeve of a non-magnetic material, having substantially the same width as a photosensitive member or a recording paper (hereinafter referred to as a record member), in combination with a magnet received inside the sleeve and extending the full width thereof. Either the sleeve or the magnet is caused to rotate or both may be rotated in opposite directions to convey a magnetic brush, formed by a quantity of the developer which is attracted onto the surface of the sleeve, about the sleeve axis. At a given developing position, the magnetic brush formed is brought into contact with an electrostatic latent image on the record member for converting it into a visual image.

The developer used in the magnetic brush developing process may be either a two component developer, involving the use of a carrier, or a single component developer which does not require a carrier. A two component developer comprises a mixture of toner particles formed by resins and carbons and a carrier formed by iron powder or magnetic powder. By agitation, both components are triboelectrically charged, so that they bear an electric charge of opposite polarities. An electrostatic latent image having an increased proportion of thin lines or having a reduced surface potential can be satisfactorily developed by a suitable choice of the toner and carrier materials in the triboelectricity series depending on the polarity of the latent image. However, it suffers from a poor durability which results from wear of the developer because of repeated triboelectric charging. In addition, there must be provided some means for maintaining a constant toner concentration since toner alone is subject to dissipation in developing the image.

On the other hand, the single component developer comprises iron or other magnetic powder and carbon which are bonded together with a binder into the form of particles, and is sometimes referred to as a magnetic toner. Because there is no carrier, the toner cannot be charged without a special means. In addition, since the developing is achieved by the electrostatic induction or polarization due to the static electricity of the latent image, there result difficulties that a latent image having an increased proportion of thin lines or having a reduced surface potential cannot be developed in a satisfactory manner and that the resulting image lacks sharpness.

SUMMARY OF THE INVENTION

The magnetic brush developing process according to the invention is carried out by using an arrangement which is generally similar to a conventional one, but is characterized in the use of a particular developer, which comprises a powder mixture of a low and a high resistance toner, at least one of which comprises a magnetic powder. The two toners are triboelectrically charged, and when the high resistance toner is charged to one polarity, an electric charge of the opposite polarity is induced on the low resistance toner thereby, after the electric charge by the triboelectric charge has leaked on the electrically conductive material with which the low resistance toner is in contact. By way of example, when an electrostatic image has a negative polarity, the high resistance toner is charged to the positive polarity while a charge of negative polarity is induced on the low resistance, magnetic toner which serves as a carrier. A magnetic brush is formed by these toners, and when it is brought into contact with an electrostatic image, the high resistance toner charged to the positive polarity is attracted by the negative charge of the image to result in a deposition thereon and also the magnetic toner of low resistance is deposited on the electrostatic latent image as a result of the electrostatic induction caused by the negative charge of the image and the leakage of the positive charge from the sleeve onto the low resistance toner such as disclosed in U.S. Pat. No. 3,909,258 to Kotz.

The process of the invention enables a satisfactory developing of an electrostatic image having an increased proportion of thin lines or having a reduced surface potential, with good reproducibility. Because both toners are deposited on the electrostatic image, the proportion of these toners is maintained constant, eliminating the need for an adjustment of toner concentration and an associated maintenance problem of the developing apparatus. In this manner, the developing process of the invention provides an improved durability of the developing apparatus.

Therefore, it is an object of the invention to provide a magnetic brush developing process capable of providing a satisfactory developing of an electrostatic latent image having an increased proportion of thin lines or having a reduced surface potential through the use of a developer having an improved durability and which is free from wear.

DETAILED DESCRIPTION OF PREFERRED EMBODIMENT

Figure 1:
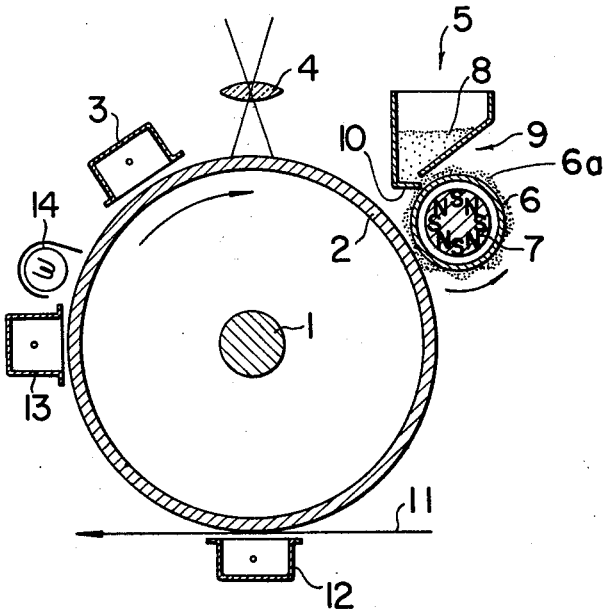
FIG. 1 is a schematic illustration of an electrophotographic copying machine which is used to carry out the present invention.

Referring to FIG. 1, there is shown a shaft 1 which carries a photosensitive drum 2 for rotation in the direction indicated by an arrow, at a uniform rate. The drum surface is initially uniformly charged by a corona discharger 3. The polarity produced by the charger 3 depends on the characteristic of a photoconductive, insulating layer formed on the surface of the drum 2. For example, when the photoconductive layer comprises zinc oxide, a d.c. voltage on the order of 6 kV of negative polarity is applied to the charger to charge the drum surface to a negative potential on the order of 400 V. The charged drum surface is exposed to an image of an original through an exposure optical system 4, whereby the charge on the drum surface is selectively removed in accordance with the image pattern to produce an electrostatic latent image thereon. The latent image is converted into a visual image by a magnetic brush developing unit 5.

The developing unit 5 comprises a sleeve 6 of a non-magnetic, conductive material which is adapted to rotate in the direction indicated by an arrow, a stationary magnet roller 7 received inside the sleeve 6, a hopper 9 containing a quantity of developer 8, and a doctor blade 10 disposed adjacent an opening formed in the lower end of the hopper 9. As the developer 8 is supplied onto the sleeve 6 through the opening in the bottom of the hopper 9, it forms a magnetic brush 6*a* on the sleeve 6, and the radial height of the magnetic brush is controlled by the doctor blade 10. The magnetic brush 6*a* is conveyed in the direction of the arrow as the sleeve 6 rotates, and is brought into contact with an electrostatic latent image on the drum 2 at a position in which the brush is directed perpendicular to the drum surface, thereby converting the latent image into a visual image. A toner image formed is brought into superimposed relationship with a transfer sheet 11 which is subjected to a d.c. corona discharge on the order of −5 kV, produced by a transfer corona discharger 12, thus transferring the toner image onto the transfer sheet 11.

Subsequent to the transfer step, the drum surface is subjected to a corona discharge on the order of 6 kV, produced by an a.c. corona discharger 13, and also to an irradiation from a white fluorescent lamp 14 of 10 W rating to provide a quenching. This frees any residual developer from the drum surface for removal therefrom, and the freed developer is removed from the drum surface by the magnetic brush. If required, a quenching step may be repeated by operating the corona discharger 13 and the lamp 14 again.

Figure 2:
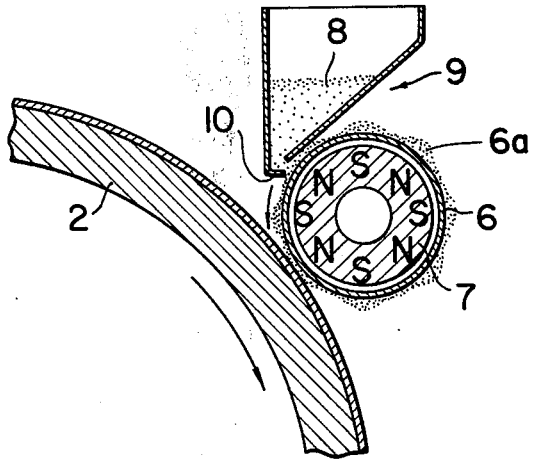
FIG. 2 is an enlarged view of the magnetic brush developing unit shown in FIG. 1.
Figure 3:
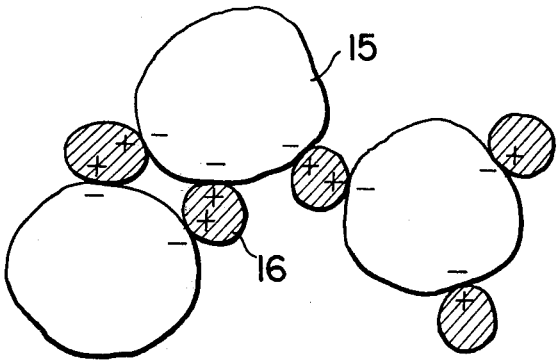
FIG. 3 is an illustration of the developer used in the present invention.
Figure 4:
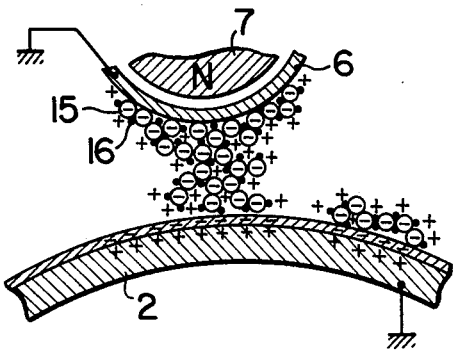
FIG. 4 is an illustration of the developing process which takes place according to the invention.

From the foregoing description, it will be noted that the developing unit used to carry out the present invention, as shown in the enlarged view of FIG. 2, is generally similar to a conventional brush developing unit. However, the present invention is distinguished from the prior art in the compositiion of the developer 8 used therein. The developer used in the invention comprises a powder mixture of a low and a high resistance toner, at least one of which is formed by a magnetic toner. FIG. 3 shows one example, illustrating a combination of a low resistance, magnetic toner 15 which may be formed by iron powder, carbon and resin so as to have a volume resistance of not more than $10^5$ Ω cm and serving as a carrier, and an ordinary high resistance toner 16 formed by resin and carbon and having a volume resistance of not less than $10^{13}$ Ω cm. It is essential that the material of the toner 16 be at a higher rank than the low resistance toner 15 in the triboelectricity series. This combination is suitable for use with a photosensitive member formed with zinc oxide or like material in which an electrostatic image is formed by a negative charge. These toners are contained within the hopper 9 as a powder mixture, and as they are supplied onto the sleeve 6 from the hopper and conveyed on the sleeve, they are triboelectrically charged, the high resistance toner 16 being charged to the positive polarity and the low resistance toner to the negative polarity. Although the electrical charge produced on the low resistance toner by the triboelectric charging decays relatively fast, a negative charge is still kept on the low resistance toner by the electrostatic induction caused by the positive charge on the high resistance toner. Thus, both toners are electrostatically attracted to each other, so that when the magnetic toner or low resistance toner 15 is attracted onto the sleeve 6 by the magnetic force from the magnet 7 located within the sleeve, the high resistance toner 16 is also attracted onto the sleeve 6, as indicated in FIG. 4. When the high resistance toner 16 which is charged to the positive polarity is attracted into contact with the latent image formed by the negative charge on the drum 2, the low resistance, magnetic toner 15 is also attracted to the latent image by the leakage of the positive charge from the grounded conductive member of the drum 2 througn the grounded sleeve 6 onto the low resistance toner 15 and by the electrostatic induction caused by the negative charge on the latent image, independently from the charge which is induced thereon previously. In this respect, it is essential that the force of electrostatic attraction between the toners and the force of electrostatic attraction acting between both toners and the latent image be greater than the force of magnetic attraction exerted by the magnet 7 upon the low resistance, magnetic toner 15, since otherwise the bonding force acting between the toners and the attraction of both toners to the latent image is overcome by the force of attraction acting on the magnetic toner by the magnet, resulting in a separation of the toners and failure to deposit both toners onto the latent image.

It is to be understood that since the developer used in the invention comprises a combination of a low resistance and a high resistance toner, at least one of which comprises a magnetic toner, the exemplary combination of the low resistance, magnetic toner and the ordinary, high resistance toner mentioned above may be replaced by a combination of an ordinary, low resistance toner and a high resistance, magnetic toner or by a combination of two magnetic toners. The choice of these combinations is determined in accordance with the characteristic of the photoconductive, insulating layer on the drum or the polarity to which the photosensitive member is charged. The force of electrostatic attraction between the toners and the force of electrostatic attraction acting between both toners and the latent image can be made greater than the force of magnetic attraction exerted upon the magnetic toner by the magnet, through a suitable choice of the orders of respective materials used for the toners in the triboelectricity series as well as the distance between the sleeve surface and the drum surface.

What is claimed is:

1. In a magnetic toner brush developing process for electrostatic images of the type in which a developer containing a magnetic powder is attracted onto a sheeve of a non-magnetic material by means of a magnet disposed within the sleeve to thereby form a magnetic brush, which brush is brought into contact with an electrostatic latent image formed on a record member to provide a developing thereof, the improvement comprising the steps of:

providing as a developer a powder mixture of a low resistance toner having a volume resistance of not more than $10^5$ Ω cm and a high resistance toner having a volume resistance of not less than $10^{13}$ Ω cm, at least one of which comprises a magnetic toner for forming the magnetic brush;

triboelectrically charging both toners;

selecting the toner materials in accordance with their orders in the triboelectricity series, the high resistance toner being of a higher order and inducing an electrostatic charge on the low resistance toner, so that the force of electrostatic attraction acting between the toners and the force of electrostatic attraction acting between both toners and the latent image are greater than the force of magnetic attraction exerted by the magnet on the magnetic toner; and causing a deposition of both toners onto the latent image to provide a developing thereof.

2. A magnetic brush developing process according to claim 1 in which the low resistance toner comprises the magnetic toner.

3. A magnetic brush developing process according to claim 1 in which the high resistance toner comprises the magnetic toner.

4. A magnetic brush developing process according to claim 1 wherein the step of selecting further comprises choosing the distance between the surface of the sleeve and the surface of the record member.

5. A magnetic brush developing process according to claim 1 wherein the step of selecting further comprises choosing the material of said record member.

6. A magnetic brush developing process according to claim 1 wherein the step of selecting further comprises choosing the charge of said electrostatic image.

* * * * *